US011312461B1

(12) United States Patent
Ito

(10) Patent No.: US 11,312,461 B1
(45) Date of Patent: Apr. 26, 2022

(54) BOAT MANEUVERING CONTROL SYSTEM FOR BOAT AND BOAT MANEUVERING CONTROL METHOD FOR BOAT

(71) Applicant: YAMAHA HATSUDOKI KABUSHIKI KAISHA, Iwata (JP)

(72) Inventor: Makoto Ito, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 106 days.

(21) Appl. No.: 17/035,803

(22) Filed: Sep. 29, 2020

Related U.S. Application Data

(60) Provisional application No. 62/927,221, filed on Oct. 29, 2019.

(51) Int. Cl.

| | |
|---|---|
| ***B63H 20/12*** | (2006.01) |
| ***B63H 25/02*** | (2006.01) |
| ***B63H 25/42*** | (2006.01) |
| *B63H 20/00* | (2006.01) |

(52) U.S. Cl.
CPC ..... *B63H 20/12* (2013.01); *B63H 25/02* (2013.01); *B63H 25/42* (2013.01); *B63H 2020/003* (2013.01)

(58) Field of Classification Search
CPC ..... B63H 20/12; B63H 25/02; B63H 25/42; B63H 2020/003
See application file for complete search history.

(56) References Cited

U.S. PATENT DOCUMENTS

| | | | | |
|---|---|---|---|---|
| 4,836,809 | A * | 6/1989 | Pelligrino | B63H 21/22 440/86 |
| 7,142,955 | B1 | 11/2006 | Kern et al. | |
| 10,633,072 | B1 * | 4/2020 | Arbuckle | B63H 21/213 |
| 2010/0151750 | A1 * | 6/2010 | Ito | B63H 20/10 440/1 |

* cited by examiner

*Primary Examiner* — Stephen P Avila
(74) *Attorney, Agent, or Firm* — Keating and Bennett, LLP

(57) ABSTRACT

A controller of a boat maneuvering control system for a boat is configured or programmed to perform a control to switch from controlling a propulsion device based on a first operation signal that includes error information, to controlling a propulsive force of the propulsion device based on a second operation signal different from the first operation signal upon acquiring the error information.

20 Claims, 8 Drawing Sheets

BOAT MANEUVERING CONTROL SYSTEM FOR BOAT AND BOAT MANEUVERING CONTROL METHOD FOR BOAT

CROSS REFERENCE TO RELATED APPLICATIONS

This application claims the benefit of priority to U.S. Provisional Application No. 62/927,221 filed on Oct. 29, 2019. The entire contents of this application are hereby incorporated herein by reference.

BACKGROUND OF THE INVENTION

1. Field of the Invention

The present invention relates to a boat maneuvering control system for a boat and a boat maneuvering control method for a boat.

2. Description of the Related Art

A boat maneuvering control system for a boat including a plurality of operators that output operation signals to control the propulsive force of a propulsion device is known in general. Such a boat maneuvering control system for a boat is disclosed in U.S. Pat. No. 7,142,955, for example.

U.S. Pat. No. 7,142,955 discloses a marine vessel control system including a control head that controls the throttle opening degree and the shift position of each of a first engine, a second engine, and a third engine. The marine vessel control system includes a first engine control unit (ECU) that controls driving of the first engine, a second ECU that controls driving of the second engine, and a third ECU that controls driving of the third engine. The control head includes a first control lever connected to the first ECU and a second control lever connected to the second ECU. The first ECU controls the throttle opening degree and the shift position of the first engine based on an operation signal from a position sensor that detects the position of the first control lever. The second ECU controls the throttle opening degree and the shift position of the second engine based on an operation signal from a position sensor that detects the position of the second control lever. The third ECU is connected to the first ECU and the second ECU via communication lines. The third ECU acquires an operation signal from the first ECU or the second ECU and controls the throttle opening degree and the shift position of the third engine based on the acquired operation signal.

It is conceivable that in a marine vessel control system (boat maneuvering control system for a boat) as disclosed in U.S. Pat. No. 7,142,955, an error may occur between an input value to a position sensor that detects the position of a first control lever or a position sensor that detects the position of a second control lever and an operation signal output from the position sensor. Furthermore, it is conceivable that a communication error may occur in communication of an operation signal between a first ECU or a second ECU, and a third ECU. Although not described in U.S. Pat. No. 7,142,955, when these errors (hereinafter referred to as "errors related to the operation signals") occur, driving of engines (propulsion devices) corresponding to the ECUs in which the errors have occurred among the first ECU, the second ECU, and the third ECU is conceivably stopped. Therefore, a propulsive force generated by a marine vessel (propulsion device) is conceivably reduced by stopping some of the engines until the errors are eliminated.

SUMMARY OF THE INVENTION

Preferred embodiments of the present invention provide boat maneuvering control systems for boats and boat maneuvering control methods for boats that each significantly reduce or prevent a reduction in the propulsive force of a propulsion device even when errors related to operation signals occur.

A boat maneuvering control system according to a first preferred embodiment of the present invention includes a propulsion device, a controller configured or programmed to control a propulsive force of the propulsion device, and a plurality of operators, each of which outputs to the controller an operation signal to control the propulsive force of the propulsion device. The controller is configured or programmed to perform a control to switch from controlling the propulsion device based on at least a first operation signal that includes error information among a plurality of operation signals output from the plurality of operators, to controlling the propulsive force of the propulsion device based on a second operation signal different from the first operation signal upon acquiring the error information.

In the boat maneuvering control system for the boat according to the first preferred embodiment, the controller is configured or programmed to perform a control to switch from controlling the propulsion device based on the first operation signal including the error information to controlling the propulsive force of the propulsion device based on the second operation signal, which is the operation signal different from the first operation signal, upon acquiring the error information. Accordingly, even when an error occurs in the first operation signal, the propulsion device is continuously driven based on the second operation signal in which an error does not occur. Consequently, unlike a case in which the propulsion device is stopped when an error occurs in the first operation signal, a reduction in the propulsive force of the propulsion device is significantly reduced or prevented even when an error occurs in the first operation signal. The advantageous effect that a reduction in the propulsive force of the propulsion device is significantly reduced or prevented even when an error occurs in the first operation signal is especially effective when the time required for the boat to return to the port is relatively long, such as when the boat is located in the open sea.

In the boat maneuvering control method for the boat according to the first preferred embodiment, the error information preferably includes at least one of information indicating that an error has been detected in the operation signal and information indicating a communication error with another controller. Accordingly, when the error information includes the information indicating that an error has been detected in the operation signal, an error due to the operator that outputs the operation signal and an error due to transmission of the operation signal between the operator and the controller are detected. When the error information includes the information indicating a communication error with another controller, a communication error between the controllers is detected. Consequently, when at least one of the errors due to the operator and due to transmission of the operation signal (first operation signal) and the communication error between the controllers occurs, the propulsion device is continuously driven based on the second operation signal such that a reduction in the propulsive force of the propulsion device is significantly reduced or prevented.

In the boat maneuvering control method for the boat according to the first preferred embodiment, the boat preferably includes a plurality of propulsion devices including at least a left propulsion device provided on a left portion of a stern of a hull, and a right propulsion device provided on a right portion of the stern of the hull, and a plurality of controllers including at least a left controller configured or programmed to control a propulsive force of the left propulsion device, and a right controller configured or programmed to control a propulsive force of the right propulsion device, the plurality of operators preferably include a left operator that outputs to the left controller a left operation signal to control the propulsive force of the left propulsion device, and a right operator that outputs to the right controller a right operation signal to control the propulsive force of the right propulsion device, and a first controller of the plurality of controllers is preferably configured or programmed to perform a control to switch from controlling the propulsion device corresponding to the first controller based on at least the first operation signal including the error information among the left operation signal and the right operation signal to controlling the propulsive force of the propulsion device corresponding to the first controller based on the second operation signal among the left operation signal and the right operation signal upon acquiring the error information. Accordingly, even when an error occurs in one (first operation signal) of the left operation signal and the right operation signal, the propulsion device corresponding to the first controller is continuously driven based on the other (second operation signal) of the left operation signal and the right operation signal. Consequently, even when an error occurs, the number of drivable propulsion devices among the plurality of propulsion devices is maintained, and thus the speed of the boat is not reduced.

In such a case, the first controller is preferably configured or programmed to perform a control to switch from controlling the propulsion device corresponding to the first controller based on at least the first operation signal to controlling the propulsive force of the propulsion device corresponding to the first controller based on the second operation signal upon acquiring information indicating that an error has been detected in the operation signal acquired from a corresponding one of the plurality of operators. Accordingly, even when an error occurs in the operation signal (first operation signal) acquired from the corresponding operator, the propulsion device corresponding to the first controller is continuously driven based on the second operation signal in which an error does not occur.

In the boat maneuvering control system for the boat including the left operator and the right operator, the plurality of propulsion devices preferably include a central propulsion device provided at a center of the stern of the hull, the first controller preferably includes a central controller configured or programmed to acquire the left operation signal from the left controller and acquire the right operation signal from the right controller so as to control a propulsive force of the central propulsion device based on the left operation signal and the right operation signal, and the central controller is preferably configured or programmed to perform a control to switch from controlling the propulsive force of the central propulsion device based on the left operation signal and the right operation signal to controlling the propulsive force of the central propulsion device based on the second operation signal, which is one of the left operation signal and the right operation signal, upon acquiring the error information. Accordingly, even when the central controller acquires the operation signals from the left controller or the right controller without directly acquiring the operation signals from the operators and an error occurs, at least the central propulsion device of the plurality of propulsion devices is continuously driven.

In the boat maneuvering control system for the boat including the central controller, the central controller is preferably configured or programmed to perform a control to switch from controlling the propulsive force of the central controller based on the left operation signal and the right operation signal to controlling the propulsive force of the central propulsion device based on the second operation signal, which is one of the left operation signal and the right operation signal, upon acquiring from the left controller or the right controller information indicating that an error has been detected in the operation signal or detecting a communication error with the left controller or the right controller. Accordingly, the central propulsion device is continuously driven even when the error in the operation signal or the communication error occurs.

In the boat maneuvering control system for the boat including the central controller, the central controller is preferably configured or programmed to perform a control to switch from controlling the central propulsion device such that the propulsive force of the central propulsion device is a substantially average value of the propulsive force based on the left operation signal and the propulsive force based on the right operation signal to controlling the central propulsion device such that the propulsive force of the central propulsion device is based on the second operation signal, which is one of the left operation signal and the right operation signal, upon acquiring the error information. Accordingly, even when controlling the propulsive force based on the left operation signal and the right operation signal is switched to controlling the propulsive force based on the second operation signal, the propulsive force of the central propulsion device is controlled without performing a relatively complex calculation. Consequently, a complex control of the propulsive force of the central propulsion device is significantly reduced or prevented.

In the boat maneuvering control method for the boat in which the first controller performs a switching control upon acquiring the error information, each of the plurality of operators preferably includes a shift operator, and the first controller is preferably configured or programmed to perform a control to switch from controlling the propulsive force of the propulsion device based on the first operation signal to controlling the propulsive force of the propulsion device based on the second operation signal when the first controller acquires the error information, and the shift operator corresponding to the second operation signal is in a neutral state. Accordingly, after the shift operator corresponding to the second operation signal is put into the neutral state (a state in which an operation signal that does not generate a propulsive force is transmitted), the propulsive force of the propulsion device is controlled based on the second operation signal. Consequently, when the magnitude of the first operation signal and the magnitude of the second operation signal are different from each other at the time of acquiring the error information, a control of the propulsive force based on the second operation signal is immediately started such that a large change in the propulsive force is significantly reduced or prevented unlike a case in which the propulsive force changes greatly.

The boat maneuvering control method for the boat according to the first preferred embodiment preferably further includes a plurality of boat maneuvering stations, each of which includes an operator and outputs the operation signal to the controller, and the controller is preferably configured or programmed to perform a control to switch from controlling the propulsion device based on the first operation signal output from a boat maneuvering station including the error information among the plurality of boat maneuvering stations, to controlling the propulsive force of the propulsion device based on the second operation signal output from a boat maneuvering station different from the boat maneuvering station including the error information upon acquiring the error information. Accordingly, even when an error occurs in one of the plurality of boat maneuvering stations, the propulsion device is continuously driven based on the operation signal output from the other of the plurality of boat maneuvering stations.

In such a case, at least one of the plurality of boat maneuvering stations preferably includes the plurality of operators and a signal transmission controller configured or programmed to acquire the operation signal from each of the plurality of operators and transmit the operation signal to the controller, and the controller is preferably configured or programmed to perform a control to switch from controlling the propulsion device based on the first operation signal to controlling the propulsive force of the propulsion device based on the second operation signal upon acquiring, from the signal transmission controller, information indicating that an error has been detected in the operation signal or acquiring a communication error with the signal transmission controller. Accordingly, the signal transmission controller that acquires the operation signal from each of the plurality of operators is provided such that an increase in the number of controllers is significantly reduced or prevented, unlike a case in which a number of controllers corresponding to the plurality of operators are provided in each of the plurality of boat maneuvering stations. Consequently, even when an error occurs in one of the plurality of boat maneuvering stations, the propulsion device is continuously driven based on the operation signal output from the other of the plurality of boat maneuvering stations while an increase in the number of controllers is significantly reduced or prevented.

A boat maneuvering control system for a boat according to a second preferred embodiment of the present invention includes a plurality of propulsion devices including at least a left propulsion device provided on a left portion of a stern of a hull, and a right propulsion device provided on a right portion of the stern of the hull, a plurality of controllers including at least a left controller configured or programmed to control a propulsive force of the left propulsion device, and a right controller configured or programmed to control a propulsive force of the right propulsion device, and a plurality of operators including a left operator that outputs to the left controller a left operation signal to control the propulsive force of the left propulsion device, and a right operator that outputs to the right controller a right operation signal to control the propulsive force of the right propulsion device. A first controller of the plurality of controllers is configured or programmed to perform a control to switch from controlling a propulsion device corresponding to the first controller among the plurality of propulsion devices based on at least a first operation signal that includes error information among the left operation signal and the right operation signal to controlling a propulsive force of the propulsion device corresponding to the first controller based on a second operation signal different from the first operation signal among the left operation signal and the right operation signal upon acquiring the error information.

In the boat maneuvering control system for the boat according to the second preferred embodiment, the first controller is configured or programmed to perform a control to switch from controlling the propulsion device corresponding to the first controller based on the first operation signal to controlling the propulsive force of the propulsion device corresponding to the first controller based on the second operation signal upon acquiring the error information. Accordingly, the boat maneuvering control system for the boat that significantly reduces or prevents a reduction in the propulsive force of the propulsion device even when an error occurs in the left operation signal or the right operation signal is provided.

A boat maneuvering control system for a boat according to a third preferred embodiment of the present invention includes a propulsion device, a controller configured or programmed to control a propulsive force of the propulsion device, and a plurality of boat maneuvering stations, each of which includes an operator that outputs an operation signal to control the propulsive force of the propulsion device and outputs the operation signal to the controller. The controller is configured or programmed to perform a control to switch from controlling the propulsion device based on the operation signal output from a boat maneuvering station that includes error information among the plurality of boat maneuvering stations to controlling the propulsive force of the propulsion device based on the operation signal output from a boat maneuvering station different from the boat maneuvering station including the error information upon acquiring the error information.

In the boat maneuvering control system for the boat according to the third preferred embodiment, the controller is configured or programmed to perform a control to switch from controlling the propulsion device based on the operation signal output from the boat maneuvering station including the error information among the plurality of boat maneuvering stations to controlling the propulsive force of the propulsion device based on the operation signal output from the boat maneuvering station different from the boat maneuvering station including the error information upon acquiring the error information. Accordingly, the boat maneuvering control system for the boat that significantly reduces or prevents a reduction in the propulsive force of the propulsion device even when an error occurs in the operation signal from the boat maneuvering station is provided.

A boat maneuvering control method for a boat for controlling a propulsive force of a propulsion device according to a fourth preferred embodiment of the present invention includes outputting a plurality of operation signals to control the propulsive force of the propulsion device, and performing a control to switch from controlling the propulsion device based on at least a first operation signal that includes error information among the plurality of operation signals that have been output, to controlling the propulsive force of the propulsion device based on a second operation signal, which is an operation signal different from the first operation signal, upon acquiring the error information.

In the boat maneuvering control method for the boat according to the fourth preferred embodiment, the control to switch from controlling the propulsion device based on the first operation signal to controlling the propulsive force of the propulsion device based on the second operation signal, which is the operation signal different from the first operation signal, is performed. Accordingly, the boat maneuvering control method for the boat that significantly reduces or prevents a reduction in the propulsive force of the propulsion device even when an error occurs in the operation signal is provided.

In the boat maneuvering control method for the boat according to the fourth preferred embodiment, the boat preferably includes a plurality of controllers configured or programmed to control the propulsive force of the propulsion device, the plurality of controllers are preferably configured or programmed to communicate the plurality of operation signals with each other, and the performing of the switching control preferably includes performing a control to switch from controlling the propulsion device based on the first operation signal including the error information to controlling the propulsive force of the propulsion device based on the second operation signal upon acquiring the error information including at least acquiring information including at least one of information indicating that an error has been detected in the operation signals and information indicating a communication error between the plurality of controllers. Accordingly, when at least one of the errors due to the operator and due to transmission of the operation signal (first operation signal) and the communication error between the controllers occurs, the propulsion device is continuously driven based on the second operation signal such that a reduction in the propulsive force of the propulsion device is significantly reduced or prevented.

In the boat maneuvering control method for the boat according to the fourth preferred embodiment, the boat preferably includes a plurality of propulsion devices including at least a left propulsion device provided on a left portion of a stern of a hull, and a right propulsion device provided on a right portion of the stern of the hull, the outputting of the plurality of operation signals preferably includes outputting a left operation signal to control a propulsive force of the left propulsion device among the plurality of operation signals, and outputting a right operation signal to control a propulsive force of the right propulsion device among the plurality of operation signals, and the performing of the switching control preferably includes performing a control to switch from controlling the propulsion device based on at least the first operation signal including the error information among the left operation signal and the right operation signal to controlling the propulsive force of the propulsion device based on the second operation signal, which is one of the left operation signal and the right operation signal, upon acquiring the error information. Accordingly, even when an error occurs in one (first operation signal) of the left operation signal and the right operation signal, the propulsion device corresponding to the first controller is continuously driven based on the other (second operation signal) of the left operation signal and the right operation signal. Consequently, even when an error occurs, the number of drivable propulsion devices among the plurality of propulsion devices is maintained, and thus the speed of the boat is not reduced.

In the boat maneuvering control method for the boat according to the fourth preferred embodiment, the plurality of propulsion devices preferably include a central propulsion device provided at a center of the stern of the hull, and the performing of the switching control preferably includes performing a control to switch from controlling a propulsive force of the central propulsion device based on the left operation signal and the right operation signal to controlling a propulsive force of the central propulsion device based on the second operation signal, which is one of the left operation signal and the right operation signal, upon acquiring the error information. Accordingly, even when the central controller acquires the operation signals from the left controller or the right controller without directly acquiring the operation signals from the operators and an error occurs, at least the central propulsion device of the plurality of propulsion devices is continuously driven.

In such a case, the boat preferably includes a left controller configured or programmed to control the propulsive force of the left propulsion device, a right controller configured or programmed to control the propulsive force of the right propulsion device, and a central controller configured or programmed to communicate with each of the left controller and the right controller and control the propulsive force of the central propulsion device, and the performing of the switching control preferably includes performing a control to switch from controlling the propulsive force of the central propulsion device based on the left operation signal and the right operation signal to controlling the propulsive force of the central propulsion device based on the second operation signal, which is one of the left operation signal and the right operation signal, when the central controller acquires from the left controller or the right controller information indicating that an error has been detected in the operation signal or detects a communication error with the left controller or the right controller. Accordingly, the central propulsion device is continuously driven even when the error in the operation signal or the communication error occurs.

In the boat maneuvering control method for the boat including the central propulsion device, the performing of the switching control preferably includes performing a control to switch from controlling the central propulsion device such that the propulsive force of the central propulsion device is a substantially average value of the propulsive force based on the left operation signal and the propulsive force based on the right operation signal to controlling the central propulsion device such that the propulsive force of the central propulsion device is based on the second operation signal, which is one of the left operation signal and the right operation signal, upon acquiring the error information. Accordingly, even when controlling the propulsive force based on the left operation signal and the right operation signal is switched to controlling the propulsive force based on the second operation signal, the propulsive force of the central propulsion device is controlled without performing a relatively complex calculation. Consequently, a complex control of the propulsive force of the central propulsion device is significantly reduced or prevented.

In the boat maneuvering control method for the boat including the outputting of the left operation signal and the right operation signal, the performing of the switching control preferably includes performing a control to switch from controlling the propulsive force of the propulsion device based on the first operation signal to controlling the propulsive force of the propulsion device based on the second operation signal when the error information is acquired and a shift state corresponding to the second operation signal is in a neutral state. Accordingly, after the shift operator corresponding to the second operation signal is put into the neutral state (a state in which an operation signal that does not generate a propulsive force is transmitted), the propulsive force of the propulsion device is controlled based on the second operation signal. Consequently, when the magnitude of the first operation signal and the magnitude of the second operation signal are different from each other at the time of acquiring the error information, a control of the propulsive force based on the second operation signal is immediately started such that a change in the propulsive force is significantly reduced or prevented unlike a case in which the propulsive force changes greatly.

In the boat maneuvering control method for the boat according to the fourth preferred embodiment, the outputting of the operation signals preferably includes outputting the operation signals from a plurality of boat maneuvering stations, respectively, and the performing of the switching control preferably includes performing a control to switch from controlling the propulsion device based on the first operation signal output from a boat maneuvering station including the error information among the plurality of boat maneuvering stations, to controlling the propulsive force of the propulsion device based on the second operation signal output from a boat maneuvering station different from the boat maneuvering station including the error information upon acquiring the error information. Accordingly, even when an error occurs in one of the plurality of boat maneuvering stations, the propulsion device is continuously driven based on the operation signal output from the other of the plurality of boat maneuvering stations.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

First Preferred Embodiment

The structure of a boat 1 including a boat maneuvering control system 100 according to a first preferred embodiment of the present invention is now described with reference to FIGS. 1 to 4. In the figures, arrow FWD represents the forward movement direction of the boat 1 in a forward-rearward direction, and arrow BWD represents the reverse movement direction of the boat 1. In addition, in the figures, arrow R represents the starboard direction of the boat 1 in a width direction (a direction perpendicular to the forward-rearward direction), and arrow L represents the portside direction of the boat 1.

Figure 1:
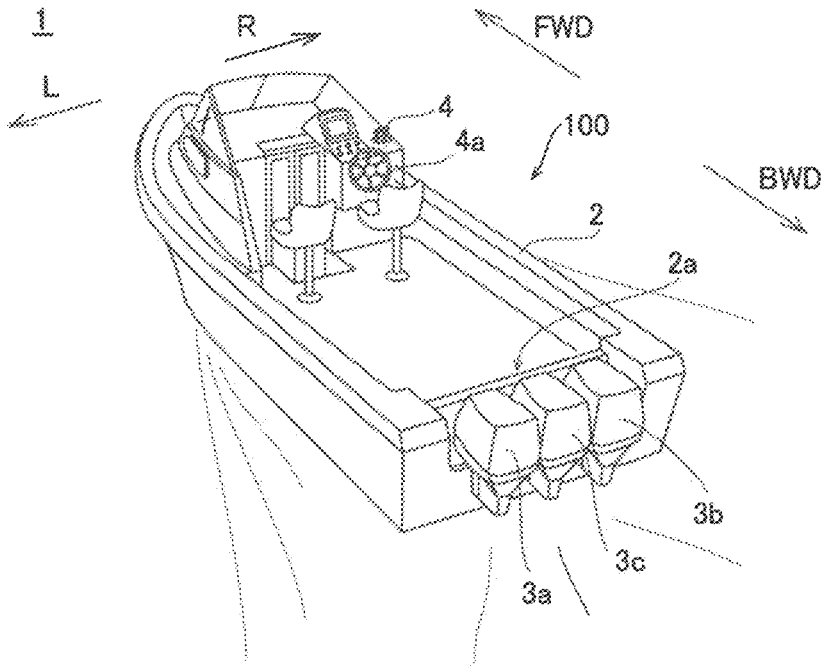
FIG. 1 is a perspective view schematically showing a boat including a boat maneuvering control system according to a first preferred embodiment of the present invention.

As shown in FIG. 1, the boat 1 includes a hull 2 and the boat maneuvering control system 100. The boat maneuvering control system 100 includes outboard motors 3*a*, 3*b*, and 3*c*, a remote control 4, and a steering wheel 4*a*. The outboard motor 3*a* is an example of a "propulsion device" or a "left propulsion device". The outboard motor 3*b* is an example of a "propulsion device" or a "right propulsion device". The outboard motor 3*c* is an example of a "propulsion device" or a "central propulsion device".

The outboard motor 3*a* is attached to the left of the center of the stern 2*a* of the hull 2 in a right-left direction. The outboard motor 3*b* is attached to the right of the center of the stern 2*a* of the hull 2 in the right-left direction. The outboard motor 3*c* is attached to the center (or the vicinity of the center) of the stern 2*a* of the hull 2 in the right-left direction.

Figure 2:
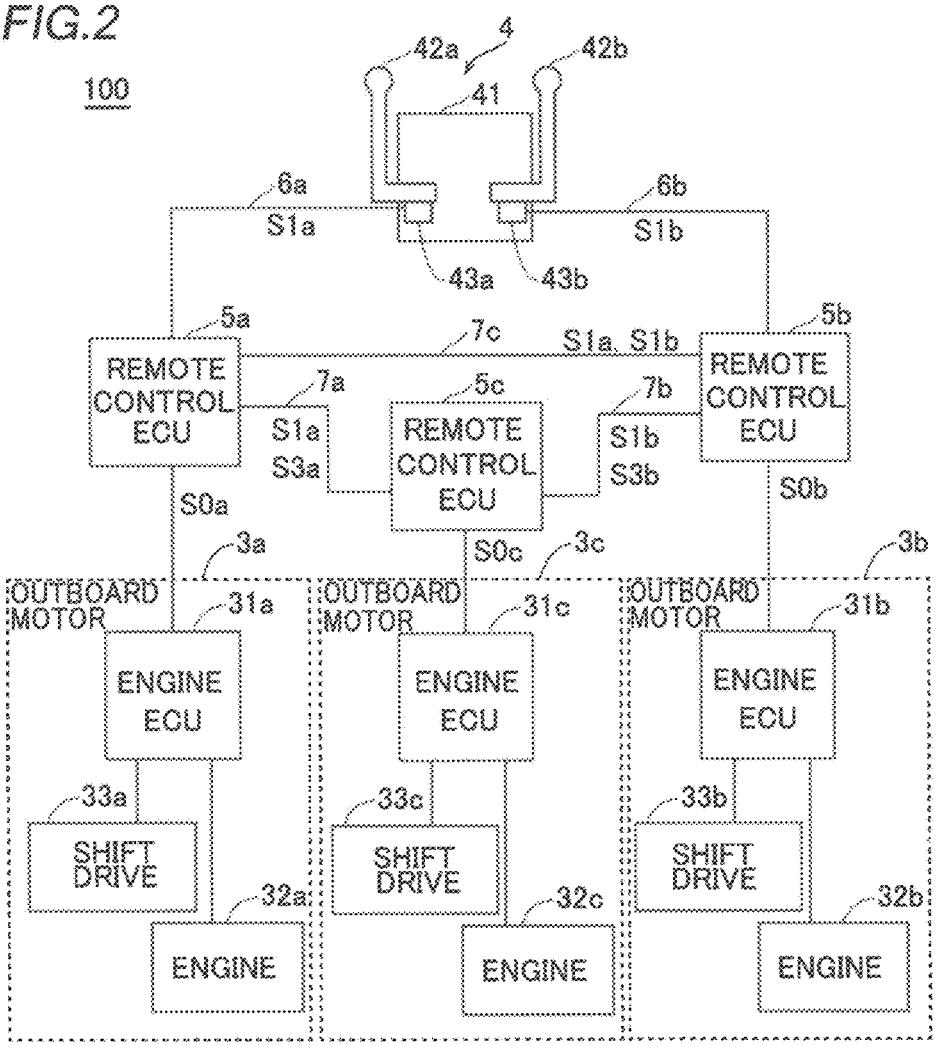
FIG. 2 is a block diagram showing the structure of the boat maneuvering control system according to the first preferred embodiment of the present invention.

As shown in FIG. 2, the boat maneuvering control system 100 includes remote control electronic control units (remote control ECUs) 5*a*, 5*b*, and 5*c*, cables 6*a* and 6*b*, and communication cables 7*a*, 7*b*, and 7*c*. The remote control ECU 5*a* is an example of a "controller", a "first controller", or a "left controller". The remote control ECU 5*b* is an example of a "controller", a "first controller", or a "right controller". The remote control ECU 5*c* is an example of a "controller", a "first controller", or a "central controller".

The outboard motor 3*a* includes an engine ECU 31*a*, an engine 32*a*, and a shift drive 33*a*. The engine ECU 31*a* acquires a control target signal S0*a* from the remote control ECU 5*a* and controls driving of the engine 32*a* and driving of the shift drive 33*a* based on the control target signal S0*a*. The engine 32*a* generates a propulsive force by rotating a propeller via a drive shaft and a propeller shaft (not shown). The shift drive 33*a* switches a connection between the drive shaft and the propeller shaft to switch between a state in which a propulsive force is directed forward (forward movement state F), a state in which a propulsive force is directed rearward (reverse movement state R), and a state in which a propulsive force is not generated (neutral state N).

The outboard motor 3*b* includes an engine ECU 31*b*, an engine 32*b*, and a shift drive 33*b*. The outboard motor 3*c* includes an engine ECU 31*c*, an engine 32*c*, and a shift drive 33*c*. The engine ECU 31*b* acquires a control target signal S0*b* from the remote control ECU 5*b* and controls driving of the engine 32*b* and driving of the shift drive 33*b* based on the control target signal S0*b*. The engine ECU 31*c* acquires a control target signal S0*c* from the remote control ECU 5*c* and controls driving of the engine 32*c* and driving of the shift drive 33*c* based on the control target signal S0*c*.

The remote control 4 includes a remote control housing 41, levers 42*a* and 42*b*, and sensors 43*a* and 43*b*. The lever 42*a* is attached to the left side of the remote control housing 41, for example. The lever 42*b* is attached to the right side of the remote control housing 41, for example. The sensor 43*a* detects the rotational position of the lever 42*a* and outputs a detected signal as an operation signal Sla to the remote control ECU 5*a*. The sensor 43*b* detects the rotational position of the lever 42*b* and outputs a detected signal as an operation signal S1*b* to the remote control ECU 5*b*. The operation signal S1*a* is an example of a "left operation signal", a "first operation signal", or a "second operation signal". The operation signal S1*b* is an example of a "right operation signal", a "first operation signal", or a "second operation signal". The lever 42*a* is an example of an "operator", a "left operator", or a "shift operator". The lever 42*b* is an example of an "operator", a "right operator", or a "shift operator".

Figure 3:
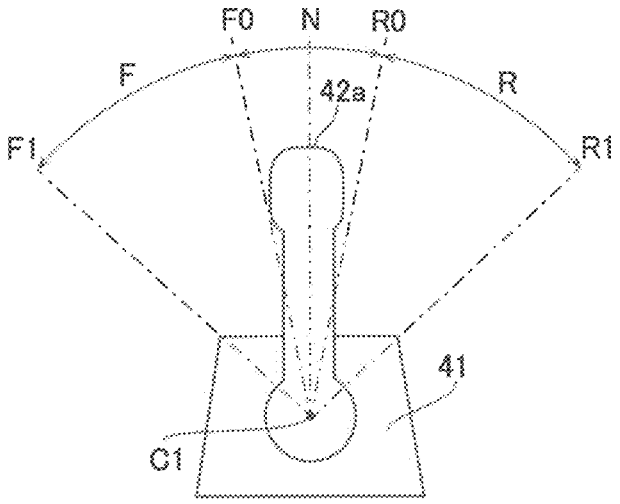
FIG. 3 is a side view schematically showing a remote control according to the first preferred embodiment of the present invention.

As shown in FIG. 3, the lever 42*a* is rotatable about a position attached to the remote control housing 41 as a fulcrum C1. The sensor 43*a* detects the rotational position of the lever 42*a*. The sensor 43*a* outputs the detected rotational position of the lever 42*a* as the operation signal S1*a* to the remote control ECU 5*a*. For example, assuming that a position at which the lever 42*a* is upright corresponds to the neutral state N, a position at which the lever 42*a* is tilted forward corresponds to the forward movement state F, and a position at which the lever 42*a* is tilted rearward corresponds to the reverse movement state R, the sensor 43*a* outputs the operation signal S1*a* to the remote control ECU 5*a* via the cable 6*a*. The operation signal S1*a* is output to generate a larger forward propulsive force as the lever 42*a* is tilted forward from a position F0 to a position F1. The operation signal S1*a* is output to generate a larger rearward propulsive force as the lever 42*a* is tilted rearward from a position R0 to a position R1. The lever 42*b* has the same or similar structure as the lever 42*a*. The sensor 43*b* outputs the operation signal S1*b* to the remote control ECU 5*b* via the cable 6*b*.

As shown in FIG. 2, the remote control ECUs 5*a* to 5*c* communicate with each other via the communication cables 7*a* and 7*b*. For example, controller area network (CAN) communication is possible between the remote control ECUs 5*a* to 5*c*.

The remote control ECU 5*a* generates the control target signal S0*a* based on the operation signal S1*a* acquired from the sensor 43*a* of the remote control 4. The remote control ECU 5*a* transmits the control target signal S0*a* to the engine ECU 31*a* of the outboard motor 3*a*. Furthermore, the remote control ECU 5*a* transmits the operation signal S1*a* to the remote control ECU 5*c* via the communication cable 7*a*. In addition, the remote control ECU 5*a* transmits the operation signal S1*a* to the remote control ECU 5*b* via the communication cable 7*c*.

The remote control ECU 5*b* generates the control target signal S0*b* based on the operation signal S1*b* acquired from the sensor 43*b*. The remote control ECU 5*b* transmits the control target signal S0*b* to the engine ECU 31*b* of the outboard motor 3*b*. Furthermore, the remote control ECU 5*b* transmits the operation signal S1*b* to the remote control ECU 5*c* via the communication cable 7*b*. In addition, the remote control ECU 5*b* transmits the operation signal S1*b* to the remote control ECU 5*a* via the communication cable 7*c*.

The remote control ECU 5*c* generates the control target signal S0*c* based on the operation signal S1*a* acquired from the remote control ECU 5*a* and the operation signal S1*b*. Furthermore, the remote control ECU 5*c* transmits the control target signal S0*c* to the engine ECU 31*c* of the outboard motor 3*c*. In the first preferred embodiment, the remote control ECU 5*c* transmits the control target signal S0*c* such that the propulsive force of the outboard motor 3*c* becomes a substantially average value (a median value, for example) of the propulsive force based on the operation signal S1*a* and the propulsive force based on the operation signal S1*b*.

The structure that performs the control based on acquisition of error information D according to the first preferred embodiment is now described. The remote control ECUs 5*a* to 5*c* respectively perform a control to switch from controlling the outboard motors 3*a* to 3*c* based on at least the operation signal (one of the operation signals S1*a* and Sib) that includes the error information D to controlling the propulsive forces of the outboard motors 3*a* to 3*c* based on the operation signal (the other of the operation signals S1*a* and Sib) different from the operation signal including the error information D upon acquiring the error information D.

Figure 4:
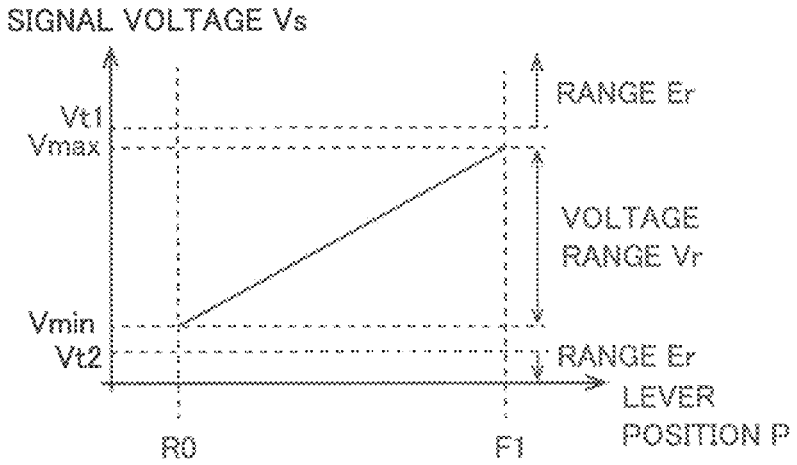
FIG. 4 is a diagram showing an example of a signal voltage of an operation signal according to the first preferred embodiment of the present invention.

Specifically, each of the remote control ECUs 5*a* to 5*c* acquires the error information D. For example, as shown in FIG. 4, when the signal voltage Vs of the operation signal S1*a* is within a range Er outside a specified voltage range Vr, the remote control ECU 5*a* acquires information D1*a* indicating that the operation signal S1*a* output from the remote control 4 includes an error. More specifically, when the signal voltage Vs becomes higher (a voltage value Vt1 or more, for example) than the maximum value Vmax in the normal time or becomes lower (a voltage value Vt2, for example) than the minimum value Vmax in the normal time, the information D1*a* is acquired by the remote control ECU 5*a*. Furthermore, the remote control ECU 5*b* acquires information D1*b* indicating that the operation signal S1*b* output from the remote control 4 includes an error, similarly to the remote control ECU 5*a*.

As shown in FIG. 2, upon acquiring the information D1*a*, the remote control ECU 5*a* transmits an error notification signal S3*a* to the remote control ECU 5*c* via the communication cable 7*a*. Upon acquiring the information D1*b*, the remote control ECU 5*b* transmits an error notification signal S3*b* to the remote control ECU 5*c* via the communication cable 7*a*. The remote control ECU 5*c* receives the error notification signal S3*a* transmitted from the remote control ECU 5*a* as the information D1*a* indicating that the operation signal S1*a* includes an error. Furthermore, the remote control ECU 5*c* receives the error notification signal S3*b* transmitted from the remote control ECU 5*b* as the information D1*b* indicating that the operation signal Sib has an error.

The remote control ECU 5*c* acquires detection of a communication error with the remote control ECU 5*a* as communication error information D2*a*. For example, the remote control ECU 5*c* acquires the communication error information D2*a* when a communication response from the remote control ECU 5*a* is not able to be continuously acquired for a predetermined period of time. Furthermore, the remote control ECU 5*c* acquires detection of a communication error with the remote control ECU 5*b* as communication error information D2*b*. That is, the error information D includes any one of the information D1*a*, D1*b*, D2*a*, and D2*b*.

In the first preferred embodiment, the remote control ECU 5*a* performs a control to switch from controlling the outboard motor 3*a* based on the operation signal S1*a* to controlling the propulsive force of the outboard motor 3*a* based on the operation signal S1*b* upon acquiring the information D1*a*.

Specifically, the remote control ECU 5*a* switches from controlling the outboard motor 3*a* based on the operation signal S1*a* to controlling the propulsive force of the outboard motor 3*a* based on the operation signal S1*b* when the remote control ECU 5*a* acquires the error information D (information D1*a*), and the lever 42*b* corresponding to the operation signal S1*b* is in the neutral state N. For example, the remote control ECU 5*a* temporarily stops driving of the outboard motor 3*a* upon acquiring the error information D. Then, the remote control ECU 5*a* transmits the control target signal S0*a* based on the operation signal S1*b* to the engine ECU 31*a* to restart driving of the outboard motor 3*a* upon acquiring the information D3*b* indicating that the lever 42*b* is in the neutral state N by communication with the remote control ECU 5*b*. The structure of the remote control ECU 5*b* is the same or similar as that of the remote control ECU 5*a*.

The remote control ECU 5*c* switches from controlling the outboard motor 3*c* based on the operation signals S1*a* and Sib to controlling the propulsive force of the outboard motor 3*c* based on the operation signal S1*b* when the remote control ECU 5*c* acquires the error information D (information D1*a* or D2*a*), and the lever 42*b* corresponding to the operation signal S1*b* is in the neutral state N.

For example, the remote control ECU 5*c* temporarily stops driving of the outboard motor 3*c* upon acquiring the error information D. Then, the remote control ECU 5*c* transmits the control target signal S0*c* based on the operation signal S1*b* to the engine ECU 31*c* to restart driving of the outboard motor 3*c* upon acquiring the information D3*b* indicating that the lever 42*b* is in the neutral state N by communication with the remote control ECU 5*b*. In such a case, the remote control ECU 5*c* changes from controlling the outboard motor 3*c* such that the propulsive force is an average value (substantially average value) of the propulsive force based on the operation signal S1*a* and the propulsive force based on the operation signal S1*b* to controlling the outboard motor 3*c* such that the propulsive force is based on the operation signal S1*b*, for example. The remote control ECU 5*c* changes from controlling the propulsive force based on the operation signal S1*a* and the operation signal S1*b* to controlling the propulsive force based on the operation signal S1*a* upon acquiring the information D1*b* or D2*b*.

A boat maneuvering control method for the boat 1 (boat maneuvering control system 100) according to the first preferred embodiment is now described with reference to FIGS. 5 and 6. This control process is executed by the remote control ECUs 5*a* to 5*c*.

Figure 5:
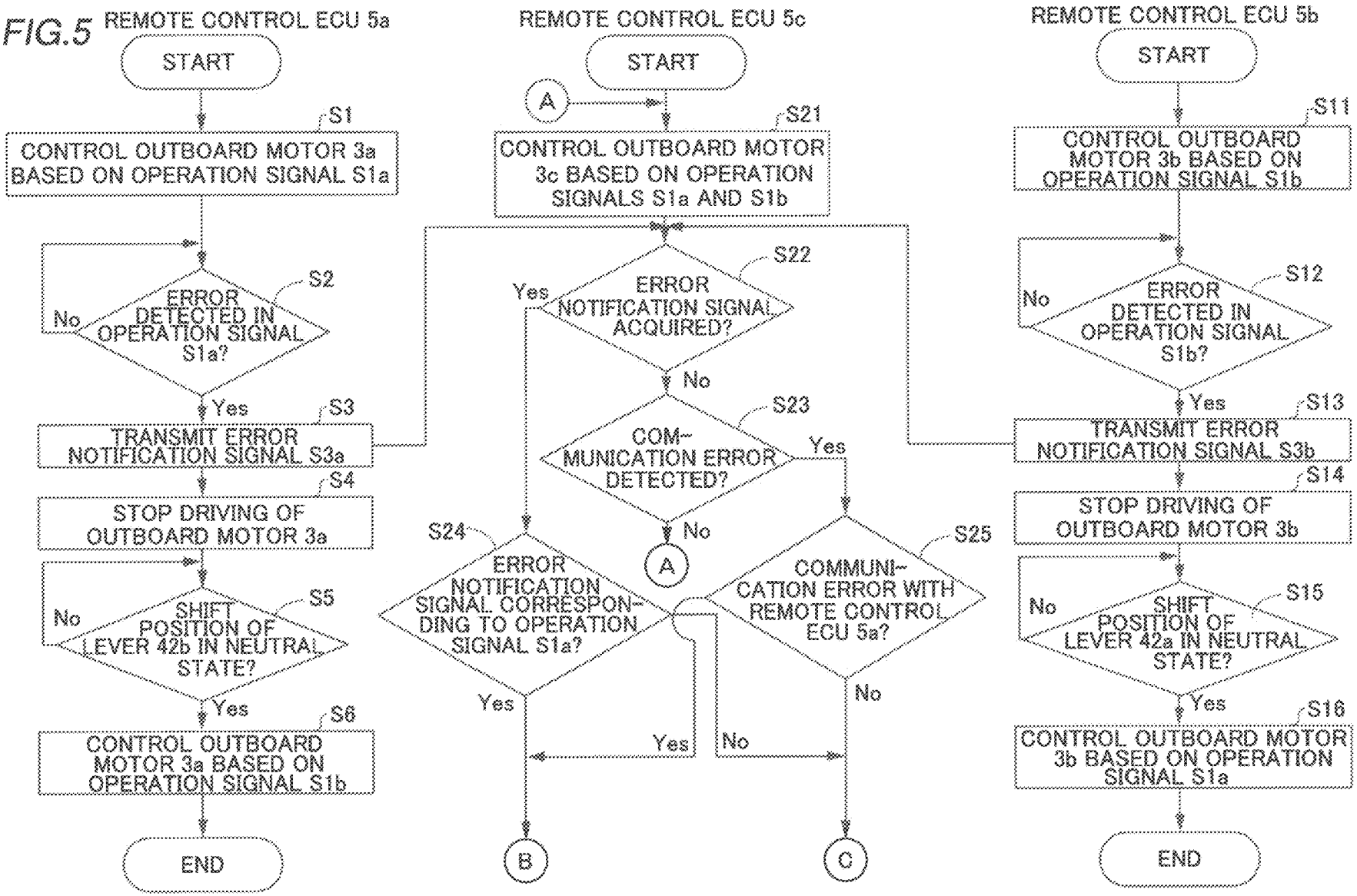
FIG. 5 is a flowchart showing a control process of the boat maneuvering control system according to the first preferred embodiment of the present invention.

As shown in FIG. 5, in step S1, the remote control ECU 5*a* controls the outboard motor 3*a* based on the operation signal Sla. Then, in step S2, it is determined whether or not an error has been detected in the operation signal Sla. This determination is repeated until the error has been detected in the operation signal S1*a*, and when the error has been detected in the operation signal Sla, the process advances to step S3.

In step S3, the error notification signal S3*a* is transmitted from the remote control ECU 5*a* to the remote control ECU 5*c*. Then, in step S4, driving of the outboard motor 3*a* corresponding to the remote control ECU 5*a* is stopped. Then, in step S5, it is determined whether or not the shift position of the lever 42*b* is in the neutral state N. This determination in step S5 is repeated until the shift position of the lever 42*b* has been put into the neutral state N. After the shift position of the lever 42*b* has been put into the neutral state N, the process advances to step S6.

In step S6, the remote control ECU 5*a* controls the outboard motor 3*a* based on the operation signal S1*b*. That is, controlling the outboard motor 3*a* based on the operation signal S1*a* is switched to controlling the outboard motor 3*a* based on the operation signal S1*b*. Then, the remote control ECU 5*a* terminates the control of switching from controlling the outboard motor 3*a* based on the operation signal S1*a* to controlling the outboard motor 3*a* based on the operation signal Sib.

In step S11, the remote control ECU 5*b* controls the outboard motor 3*b* based on the operation signal S1*b*. Then, in step S12, it is determined whether or not an error has been detected in the operation signal S1*b*. This determination is repeated until the error has been detected in the operation signal S1*b*, and when the error has been detected in the operation signal S1*b*, the process advances to step S13.

In step S13, the error notification signal S3*b* is transmitted from the remote control ECU 5*b* to the remote control ECU 5*c*. Then, in step S14, driving of the outboard motor 3*b* corresponding to the remote control ECU 5*b* is stopped. Then, in step S15, it is determined whether or not the shift position of the lever 42*a* is in the neutral state N. This determination in step S15 is repeated until the shift position of the lever 42*a* has been put into the neutral state N. After the shift position of the lever 42*a* has been put into the neutral state N, the process advances to step S16.

In step S16, the remote control ECU 5*b* controls the outboard motor 3*a* based on the operation signal S1*a*. That is, controlling the outboard motor 3*b* based on the operation signal Sib is switched to controlling the outboard motor 3*b* based on the operation signal S1*a*. Then, the remote control ECU 5*b* terminates the control of switching from controlling the outboard motor 3*b* based on the operation signal S1*b* to controlling the outboard motor 3*b* based on the operation signal S1*a*.

In step S21, the remote control ECU 5*c* controls the outboard motor 3*c* based on the operation signals S1*a* and Sib. Then, in step S22, it is determined whether or not the error notification signal S3*a* or S3*b* has been acquired. When the error notification signal S3*a* or S3*b* has not been acquired, the process advances to step S23, and when either the error notification signal S3*a* or S3*b* has been acquired, the process advances to step S24.

In step S23, it is determined whether or not either a communication error between the remote control ECU 5*c* and the remote control ECU 5*a* or a communication error between the remote control ECU 5*c* and the remote control ECU 5*b* has been detected. When a communication error has not been detected, the process returns to step S21, and when a communication error has been detected, the process advances to step S25.

In step S24 to which the process advances when either the error notification signal S3*a* or S3*b* has been acquired, it is determined whether or not the acquired error notification signal corresponds to the operation signal S1*a*. When the acquired error notification signal corresponds to the operation signal S1*a*, the process advances to step S31 (see FIG. 6), and when the acquired error notification signal does not correspond to the operation signal S1*a* (i.e., corresponds to the operation signal S1*b*), the process advances to step S41 (see FIG. 6). That is, when the error notification signal S3*a* has been acquired, the process advances to step S31, and when the error notification signal S3*b* has been acquired, the process advances to step S41.

In step S25 to which the process advances when a communication error has been detected, it is determined whether or not the detected communication error is a communication error between the remote control ECU 5*c* and the remote control ECU 5*a*. When it is a communication error between the remote control ECU 5*c* and the remote control ECU 5*a*, the process advances to step S31 (see FIG. 6), and when it is not a communication error between the remote control ECU 5*c* and the remote control ECU 5*a* (i.e., when it is a communication error between the remote control ECU 5*c* and the remote control ECU 5*b*), the process advances to S41 (see FIG. 6).

Figure 6:
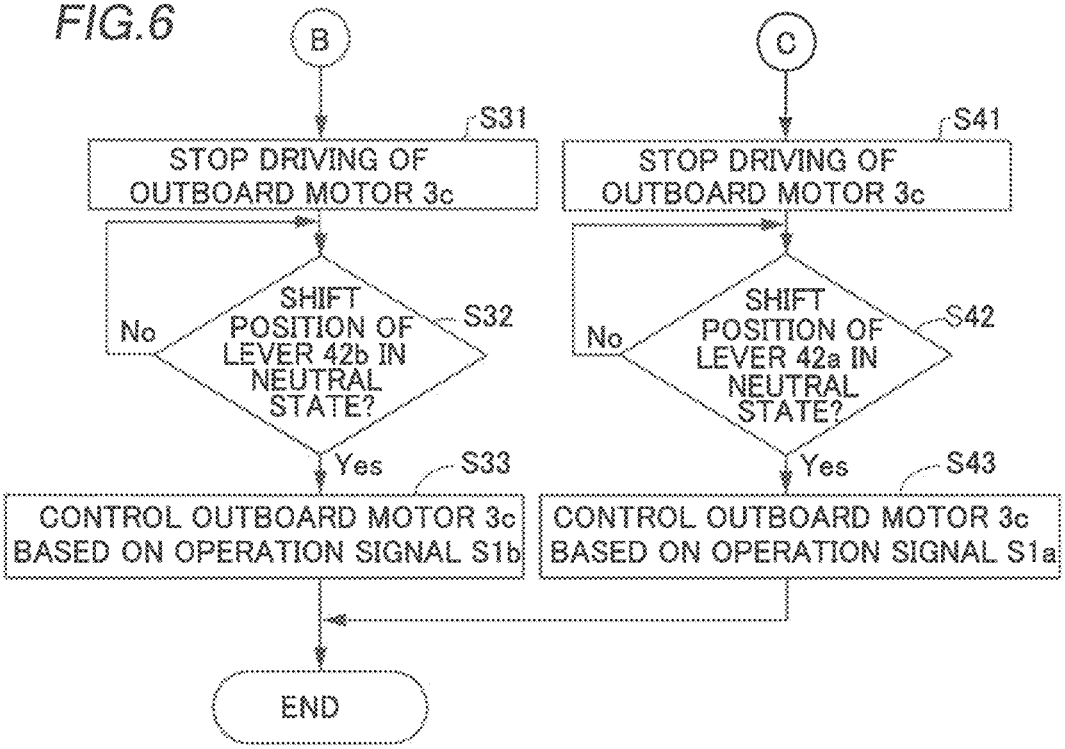
FIG. 6 is a flowchart showing the control process of the boat maneuvering control system according to the first preferred embodiment of the present invention.

As shown in FIG. 6, in step S31, driving of the outboard motor 3*c* corresponding to the remote control ECU 5*c* is stopped. Then, in step S32, it is determined whether or not the shift position of the lever 42*b* is in the neutral state N.

This determination in step S32 is repeated until the shift position of the lever 42*b* has been put into the neutral state N. After the shift position of the lever 42*b* has been put into the neutral state N, the process advances to step S33.

In step S33, the remote control ECU 5*c* controls the outboard motor 3*c* based on the operation signal S1*b*. That is, controlling the outboard motor 3*c* based on the operation signals S1*a* and S1*b* is switched to controlling the outboard motor 3*c* based on the operation signal S1*b*. Then, the remote control ECU 5*c* terminates the control of switching from controlling the outboard motor 3*c* based on the operation signals S1*a* and S1*b* to controlling the outboard motor 3*c* based on the operation signal S1*a*.

In step S41, driving of the outboard motor 3*c* corresponding to the remote control ECU 5*c* is stopped. Then, in step S42, it is determined whether or not the shift position of the lever 42*a* is in the neutral state N. This determination in step S42 is repeated until the shift position of the lever 42*a* has been put into the neutral state N. After the shift position of the lever 42*a* has been put into the neutral state N, the process advances to step S43.

In step S43, the remote control ECU 5*c* controls the outboard motor 3*c* based on the operation signal S1*a*. That is, controlling the outboard motor 3*c* based on the operation signals S1*a* and S1*b* is switched to controlling the outboard motor 3*c* based on the operation signal S1*a*. Then, the remote control ECU 5*c* terminates the control of switching from controlling the outboard motor 3*c* based on the operation signals S1*a* and Sib to controlling the outboard motor 3*c* based on the operation signal S1*a*.

According to the first preferred embodiment, the following advantageous effects are achieved.

According to the first preferred embodiment, the remote control ECU 5*a* (5*b*, 5*c*) performs a control to switch from controlling the outboard motor 3*a* (3*b*, 3*c*) based on the operation signal S1*a* (S1*b*) including the error information D to controlling the propulsive force of the outboard motor 3*a* (3*b*, 3*c*) based on the operation signal S1*b* (S1*a*) different from the operation signal S1*a* (S1*b*) upon acquiring the error information D. Accordingly, even when an error occurs in the operation signal S1*a* (S1*b*), the outboard motor 3*a* (3*b*, 3*c*) is continuously driven based on the operation signal S1*b* (S1*a*) in which an error does not occur. Consequently, unlike a case in which the outboard motor 3*a* (3*b*, 3*c*) is stopped when an error occurs in the operation signal S1*a* (S1*b*), a reduction in the propulsive force of the outboard motor 3*a* (3*b*, 3*c*) is significantly reduced or prevented even when an error occurs in the operation signal S1*a* (S1*b*). The advantageous effect that a reduction in the propulsive force of the outboard motor 3*a* (3*b*, 3*c*) is significantly reduced or prevented even when an error occurs in the operation signal S1*a* (S1*b*) is especially effective when the time required for the boat 1 to return to the port is relatively long, such as when the boat 1 is located in the open sea.

According to the first preferred embodiment, the error information D includes at least one of the information D1*a* (D1*b*) indicating that an error has been detected in the operation signal S1*a* (S1*b*) and the information D2*a* (D2*b*) indicating a communication error with another remote control ECU 5*a* (5*b*, 5*c*). Accordingly, when the error information D includes the information D1*a* (D1*b*), an error due to the remote control 4 and an error due to the cable 6*a* (6*b*) are detected. When the error information D includes the information D2*a* (D2*b*), a communication error between the remote control ECUs 5*a* and 5*c* (5*b* and 5*c*) is detected. Consequently, even when at least one of the errors due to the remote control 4 and due to the cable 6*a* (6*b*) and the communication error between the remote control ECUs 5*a* and 5*c* (5*b* and 5*c*) occurs, the outboard motor 3*a* (3*b*, 3*c*) is continuously driven based on the operation signal S1*b* (S1*a*) such that a reduction in the propulsive force of the outboard motor 3*a* (3*b*, 3*c*) is significantly reduced or prevented.

According to the first preferred embodiment, the boat 1 includes a plurality of outboard motors (3*a*, 3*b*, 3*c*) including at least the outboard motor 3*a* on the left portion of the stern 2*a* of the hull 2 and the outboard motor 3*b* on the right portion of the stern 2*a* of the hull 2. Furthermore, the boat 1 includes a plurality of remote control ECUs (5*a*, 5*b*, 5*c*) including at least the remote control ECU 5*a* that controls the propulsive force of the outboard motor 3*a* and the remote control ECU 5*b* that controls the propulsive force of the outboard motor 3*b*. In addition, the remote control 4 includes the sensor 43*a* (lever 42*a*) that outputs the operation signal S1*a* to the remote control ECU 5*a* and the sensor 43*b* (lever 42*b*) that outputs the operation signal S1*b* to the remote control ECU 5*b*. Moreover, the plurality of remote control ECUs (5*a*, 5*b*, 5*c*) perform a control to switch from controlling the outboard motor 3*a* (3*b*, 3*c*) corresponding to the remote control ECU 5*a* (5*b*, 5*c*) based on the operation signal S1*a* (S1*b*) including the error information D to controlling the propulsive force of the outboard motor 3*a* (3*b*, 3*c*) corresponding to the remote control ECU 5*a* (5*b*, 5*c*) based on the operation signal S1*b* (S1*a*) upon acquiring the error information D. Accordingly, even when an error occurs in one of the operation signals S1*a* and Sib, the outboard motor 3*a* (3*b*, 3*c*) corresponding to the remote control ECU 5*a* (5*b*, 5*c*) is continuously driven based on the other of the operation signals S1*a* and S1*b*. Consequently, even when an error occurs, the number of drivable outboard motors (3*a*, 3*b*, 3*c*) among the plurality of outboard motors (3*a*, 3*b*, 3*c*) is maintained, and thus the speed of the boat 1 is not reduced.

According to the first preferred embodiment, the remote control ECU 5*a* (5*b*) performs a control to switch from controlling the outboard motor 3*a* (3*b*) corresponding to the remote control ECU 5*a* (5*b*) based on at least the operation signal S1*a* (S1*b*) to controlling the propulsive force of the outboard motor 3*a* (3*b*) corresponding to the remote control ECU 5*a* (5*b*) based on the operation signal S1*b* (S1*a*) upon acquiring the information D1*a* (D1*b*) indicating that an error has been detected in the operation signal acquired from the sensor 43*a* (43*b*). Accordingly, even when an error occurs in the operation signal S1*a* (S1*b*) acquired from the corresponding sensor 43*a* (43*b*), the outboard motor 3*a* (3*b*) corresponding to the remote control ECU 5*a* (5*b*) is continuously driven based on the operation signal S1*b* (S1*a*) in which an error does not occur.

According to the first preferred embodiment, the boat 1 includes the outboard motor 3*c* at the center of the stern 2*a* of the hull 2. Furthermore, the remote control ECU 5*c* acquires the operation signal S1*a* from the remote control ECU 5*a* and acquires the operation signal S1*b* from the remote control ECU 5*b* to control the propulsive force of the outboard motor 3*c* based on the operation signal S1*a* and the operation signal S1*b*. In addition, the remote control ECU 5*c* performs a control to switch from controlling the propulsive force of the outboard motor 3*c* based on the operation signal S1*a* and the operation signal S1*b* to controlling the propulsive force of the outboard motor 3*c* based on the operation signal S1*b* (S1*a*), which is one of the operation signals S1*a* and Sib, upon acquiring the error information D. Accordingly, even when the remote control ECU 5*c* acquires the operation signals S1*a* and Sib from the remote control ECU 5*a* or the remote control ECU 5*b* without directly acquiring the operation signals S1*a* and Sib from the remote control 4 and an error occurs, at least the outboard motor 3*c* of the plurality of outboard motors (3*a*, 3*b*, 3*c*) is continuously driven.

According to the first preferred embodiment, the remote control ECU 5*c* performs a control to switch from controlling the propulsive force of the outboard motor 3*c* based on the operation signal S1*a* and the operation signal S1*b* to controlling the propulsive force of the outboard motor 3*c* based on the operation signal S1*b* (S1*a*), which is one of the operation signals S1*a* and Sib, upon acquiring from the remote control ECU 5*a* (5*b*) the information D1*a* (D1*b*) indicating that an error has been detected in the operation signal S1*a* (S1*b*) or detecting the information D2*a* (D2*b*) of the communication error with the remote control ECU 5*a* or the remote control ECU 5*b*. Accordingly, the outboard motor 3*c* is continuously driven even when the error in the operation signal S1*a* (S1*b*) or the communication error occurs.

According to the first preferred embodiment, the remote control ECU 5*c* performs a control to switch from controlling the outboard motor 3*c* such that the propulsive force is a substantially average value of the propulsive force based on the operation signal S1*a* and the propulsive force based on the operation signal S1*b* to controlling the outboard motor 3*c* such that the propulsive force is based on the operation signal Sib (S1*a*), which is one of the operation signals S1*a* and Sib, upon acquiring the error information D. Accordingly, even when controlling the propulsive force based on the operation signal S1*a* and the operation signal S1*b* is switched to controlling the propulsive force based on the operation signal S1*b* (S1*a*), the propulsive force of the outboard motor 3*c* is controlled without performing a relatively complex calculation. Consequently, a complex control of the propulsive force of the outboard motor 3*c* is significantly reduced or prevented.

According to the first preferred embodiment, the remote control ECU 5*a* (5*b*, 5*c*) performs a control to switch from controlling the propulsive force of the outboard motor 3*a* (3*b*, 3*c*) based on the operation signal S1*a* (S1*b*) to controlling the propulsive force of the outboard motor 3*a* (3*b*, 3*c*) based on the operation signal S1*b* (S1*a*) when the remote control ECU 5*a* (5*b*, 5*c*) acquires the error information D, and the shift position (shift state) corresponding to the operation signal S1*b* (S1*a*) is in the neutral state N. Accordingly, after the shift position corresponding to the operation signal S1*b* (S1*a*) is put into the neutral state N, the propulsive force of the outboard motor 3*a* (3*b*, 3*c*) is controlled based on the operation signal S1*b* (S1*a*). Consequently, when the magnitude of the operation signal S1*a* (S1*b*) and the magnitude of the operation signal S1*b* (S1*a*) are different from each other at the time of acquiring the error information D, a control of the propulsive force based on the operation signal S1*b* (S1*a*) is immediately started such that a large change in the propulsive force is significantly reduced or prevented unlike a case in which the propulsive force changes greatly.

Second Preferred Embodiment

The structure of a boat maneuvering control system 200 for a boat 201 according to a second preferred embodiment of the present invention is now described with reference to FIG. 7. In the second preferred embodiment, the boat 201 includes a first boat maneuvering station 202*a* including a remote control 204 and a second boat maneuvering station 202*b* including a remote control 4. The same or similar structures as those of the first preferred embodiment are denoted by the same reference numerals, and description thereof is omitted.

Figure 7:
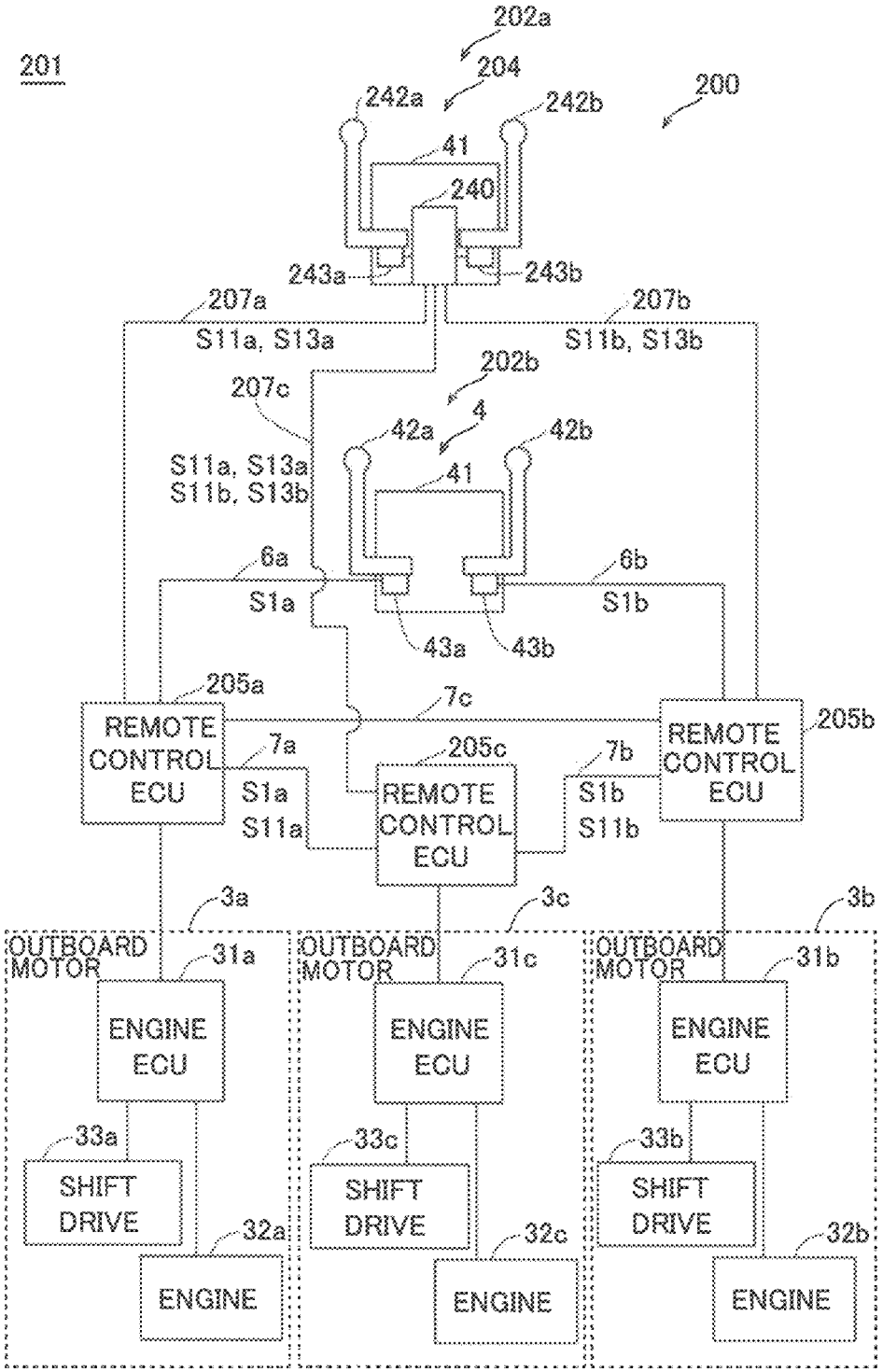
FIG. 7 is a block diagram showing the structure of a boat maneuvering control system according to a second preferred embodiment of the present invention.

As shown in FIG. 7, the boat maneuvering control system 200 according to the second preferred embodiment includes the first boat maneuvering station 202*a* and the second boat maneuvering station 202*b*. The boat 201 includes remote control ECUs 205*a*, 205*b*, and 205*c*. Furthermore, the boat 201 includes a communication cable 207*a* that communicably connects the first boat maneuvering station 202*a* to the remote control ECU 205*a*, a communication cable 207*b* that communicably connects the first boat maneuvering station 202*a* to the remote control ECU 205*b*, and a communication cable 207*c* that communicably connects the first boat maneuvering station 202*a* to the remote control ECU 205*c*.

The first boat maneuvering station 202*a* includes the remote control 204. The remote control 204 includes levers 242*a* and 242*b*, sensors 243*a* and 243*b*, and a signal transmission controller 240. The sensor 243*a* acquires an operation signal S11*a* based on the rotational position of the lever 242*a* and outputs the operation signal S11*a* to the signal transmission controller 240. The sensor 243*b* acquires an operation signal S11*b* based on the rotational position of the lever 242*b* and outputs the operation signal S11*b* to the signal transmission controller 240.

The second boat maneuvering station 202*b* includes the remote control 4. The remote control 4 outputs an operation signal Sla to the remote control ECU 205*a* and outputs an operation signal S1*b* to the remote control ECU 205*b*.

The signal transmission controller 240 includes a control circuit including a central processing unit (CPU), for example. In the second preferred embodiment, the signal transmission controller 240 is configured or programmed to transmit the operation signal S11*a* to the remote control ECU 205*a* via the communication cable 207*a*. Furthermore, the signal transmission controller 240 is configured or programmed to transmit the operation signal S11*b* to the remote control ECU 205*b* via the communication cable 207*b*. In addition, the signal transmission controller 240 is configured or programmed to transmit the operation signals S11 and S11*b* to the remote control ECU 205*c* via the communication cable 207*c*.

The signal transmission controller 240 is configured or programmed to transmit an error notification signal S13*a* to the remote control ECUs 205*a* and 205*c* upon detecting an error in the operation signal S11*a*. Furthermore, the signal transmission controller 240 is configured or programmed to transmit an error notification signal S13*b* to the remote control ECUs 205*b* and 205*c* upon detecting an error in the operation signal S11*b*.

In the second preferred embodiment, the remote control ECU 205*a* performs a control to switch from controlling an outboard motor 3*a* based on the operation signal S11*a* from the signal transmission controller 240 of the first boat maneuvering station 202*a* to controlling the outboard motor 3*a* based on the operation signal Sla from the second boat maneuvering station 202*b* upon acquiring error information D10. The error information D10 includes information indicating that the error notification signal S13*a* has been acquired from the signal transmission controller 240 or information indicating that a communication error with the signal transmission controller 240 has been detected.

The remote control ECU 205*b* performs a control to switch from controlling an outboard motor 3*b* based on the operation signal S11*b* from the signal transmission controller 240 of the first boat maneuvering station 202*a* to controlling the outboard motor 3*b* based on the operation signal S1*b* from the second boat maneuvering station 202*b*. Error information D11 includes information indicating that the error notification signal S13*b* has been acquired from the signal transmission controller 240 or information indicating that a communication error with the signal transmission controller 240 has been detected.

The remote control ECU 205*c* acquires the operation signal S1*a* from the remote control ECU 205*a*, the operation signal S1*b* from the remote control ECU 205*b*, and the operation signals S11*a* and S11*b* from the signal transmission controller 240. The remote control ECU 205*c* controls an outboard motor 3*c* based on the operation signals S11*a* and S11*b* when the remote control ECU 205*a* controls the outboard motor 3*a* based on the operation signal S11*a*, and the remote control ECU 205*b* controls the outboard motor 3*b* based on the operation signal S11*b*. The remote control ECU 205*c* controls the outboard motor 3*c* based on the operation signals S1*a* and Sib when the remote control ECU 205*a* controls the outboard motor 3*a* based on the operation signal S1*a*, or the remote control ECU 205*b* controls the outboard motor 3*b* based on the operation signal S1*b*. The remaining structures of the second preferred embodiment are similar to those of the first preferred embodiment.

A boat maneuvering control method for the boat 201 (boat maneuvering control system 200) according to the second preferred embodiment is now described with reference to FIG. 8. This control process is executed by the remote control ECU 205*a* or 205*b*. In the following description, an example is shown in which the control process is executed by the remote control ECU 205*a*, but also in the remote control ECU 205*b* (205*c*), the same or similar control process is executed while the operation signal S11*a* is replaced with S11*b* (S11*a* and S11*b*), the operation signal S1*a* is replaced with Sib (S1*a* and Sib), and the outboard motor 3*a* is replaced with 3*b* (3*c*). The remote control ECUs 205*a* to 205*c* may perform the boat maneuvering control method according to the first preferred embodiment (FIGS. 5 and 6) in addition to the control process described below.

Figure 8:
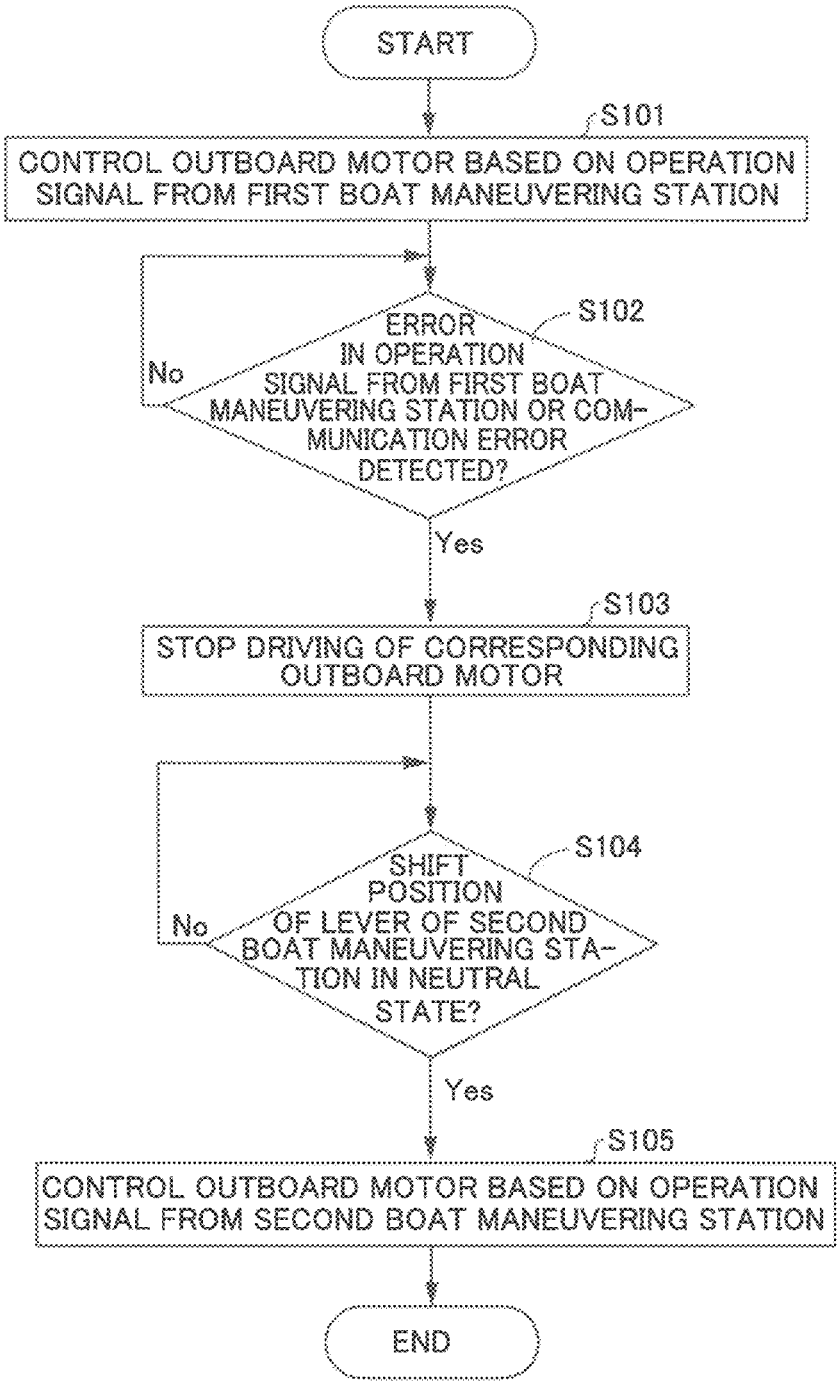
FIG. 8 is a flowchart showing a control process of the boat maneuvering control system according to the second preferred embodiment of the present invention.

As shown in FIG. 8, in step S101, the outboard motor 3*a* is controlled based on the operation signal S11*a* from the first boat maneuvering station 202*a*. Then, in step S102, it is determined whether or not an error has been detected in the operation signal S11*a* from the first boat maneuvering station 202*a*. This determination is repeated until the error has been detected in the operation signal S11*a*, and when the error has been detected in the operation signal S11*a*, the process advances to step S103.

In step S103, driving of the outboard motor 3*a* is stopped. Then, in step S104, it is determined whether or not the shift position of the lever 42*a* of the second boat maneuvering station 202*b* is in a neutral state N. This determination in step S103 is repeated until the shift position of the lever 42*a* has been put into the neutral state N. After the shift position of the lever 42*a* has been put into the neutral state N, the process advances to step S105.

In step S105, the outboard motor 3*a* is controlled based on the operation signal S1*a*. That is, controlling the outboard motor 3*a* based on the operation signal S11*a* is switched to controlling the outboard motor 3*a* based on the operation signal S1*a*. Then, the control to switch from controlling the outboard motor 3*a* based on the operation signal S11*a* from the first boat maneuvering station 202*a* to controlling the outboard motor 3*a* based on the operation signal S1*a* from the second boat maneuvering station 202*b* is terminated.

According to the second preferred embodiment, the following advantageous effects are achieved.

According to the second preferred embodiment, the boat 201 includes the first boat maneuvering station 202*a* including the remote control 204 that transmits the operation signal Sila to the remote control ECU 205*a* and transmits the operation signal S11*b* to the remote control ECU 205*b* and the second boat maneuvering station 202*b* including the remote control 4. Furthermore, the remote control ECU 205*a* (205*b*) performs a control to switch from controlling the outboard motor 3*a* (3*b*) based on the operation signal (S1*a*, Sib, Sila, or S11*b*) output from the boat maneuvering station including the error information D10 (D11) among the first boat maneuvering station 202*a* and the second boat maneuvering station 202*b* to controlling the propulsive force of the outboard motor 3*a* (3*b*) based on the operation signal output from the boat maneuvering station different from the boat maneuvering station including the error information D10 (D11) upon acquiring the error information D10 (D11). Accordingly, even when an error occurs in one of the first boat maneuvering station 202*a* and the second boat maneuvering station 202*b*, the outboard motors 3*a* and 3*b* are continuously driven based on the operation signals output from the other of the first boat maneuvering station 202*a* and the second boat maneuvering station 202*b*.

According to the second preferred embodiment, the first boat maneuvering station 202*a* includes the levers 242*a* and 242*b*, the sensors 243*a* and 243*b*, and the signal transmission controller 240 configured or programmed to acquire the operation signal S11*a* from the sensor 243*a*, acquire the operation signal S11*b* from the sensor 243*b*, transmit the operation signal S11*a* to the remote control ECU 205*a*, and transmit the operation signal S11*b* to the remote control ECU 205*b*. Furthermore, the remote control ECU 205*a* (205*b*) performs a control to switch from controlling the outboard motor 3*a* (3*b*) based on the operation signal S11*a* (S11*b*) to controlling the propulsive force of the outboard motor 3*a* (3*b*) based on the operation signal S1*a* (S1*b*) upon acquiring the information indicating that an error has been detected in the operation signal S11*a* (S11*b*) from the signal transmission controller 240 or the communication error with the signal transmission controller 240 (i.e., acquiring the error information D10 (D11)). Accordingly, the signal transmission controller 240 is provided such that an increase in the number of remote control ECUs is significantly reduced or prevented, unlike a case in which a number of controllers corresponding to a plurality of operators are provided in each of the plurality of boat maneuvering stations. Consequently, even when an error occurs in one of the first boat maneuvering station 202*a* and the second boat maneuvering station 202*b*, the outboard motor 3*a* (3*b*) is continuously driven based on the operation signal output from the other of the first boat maneuvering station 202*a* and the second boat maneuvering station 202*b* while an increase in the number of remote control ECUs is significantly reduced or prevented. The remaining advantageous effects of the second preferred embodiment are similar to those of the first preferred embodiment.

Third Preferred Embodiment

The structure of a boat maneuvering control system 300 for a boat 301 according to a third preferred embodiment of the present invention is now described with reference to FIG. 9. In the third preferred embodiment, the boat maneuvering control system 300 is for the boat 301 including two outboard motors (outboard motors 303*a* and 303*b*), unlike the first preferred embodiment in which the boat maneuvering control system 100 is for the boat 1 including three outboard motors. The same or similar structures as those of the first preferred embodiment are denoted by the same reference numerals, and description thereof is omitted.

Figure 9:
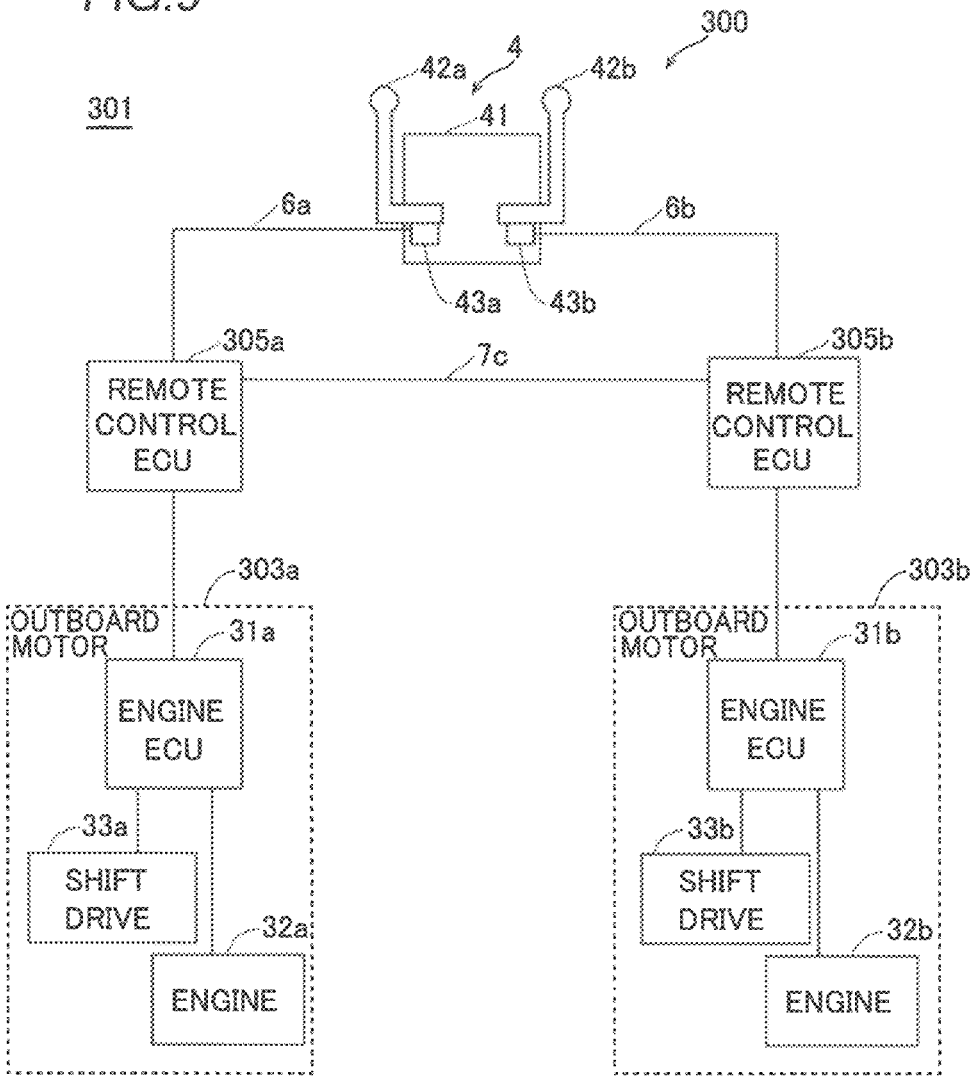
FIG. 9 is a block diagram showing the structure of a boat maneuvering control system according to a third preferred embodiment of the present invention.

As shown in FIG. 9, the boat maneuvering control system 300 for the boat 301 according to the third preferred embodiment includes the outboard motors 303*a* and 303*b* and remote control ECUs 305*a* and 305*b*. That is, the boat 301 according to the third preferred embodiment includes two outboard motors. The remaining structures of the third preferred embodiment are similar to those of the first preferred embodiment.

Figure 10:
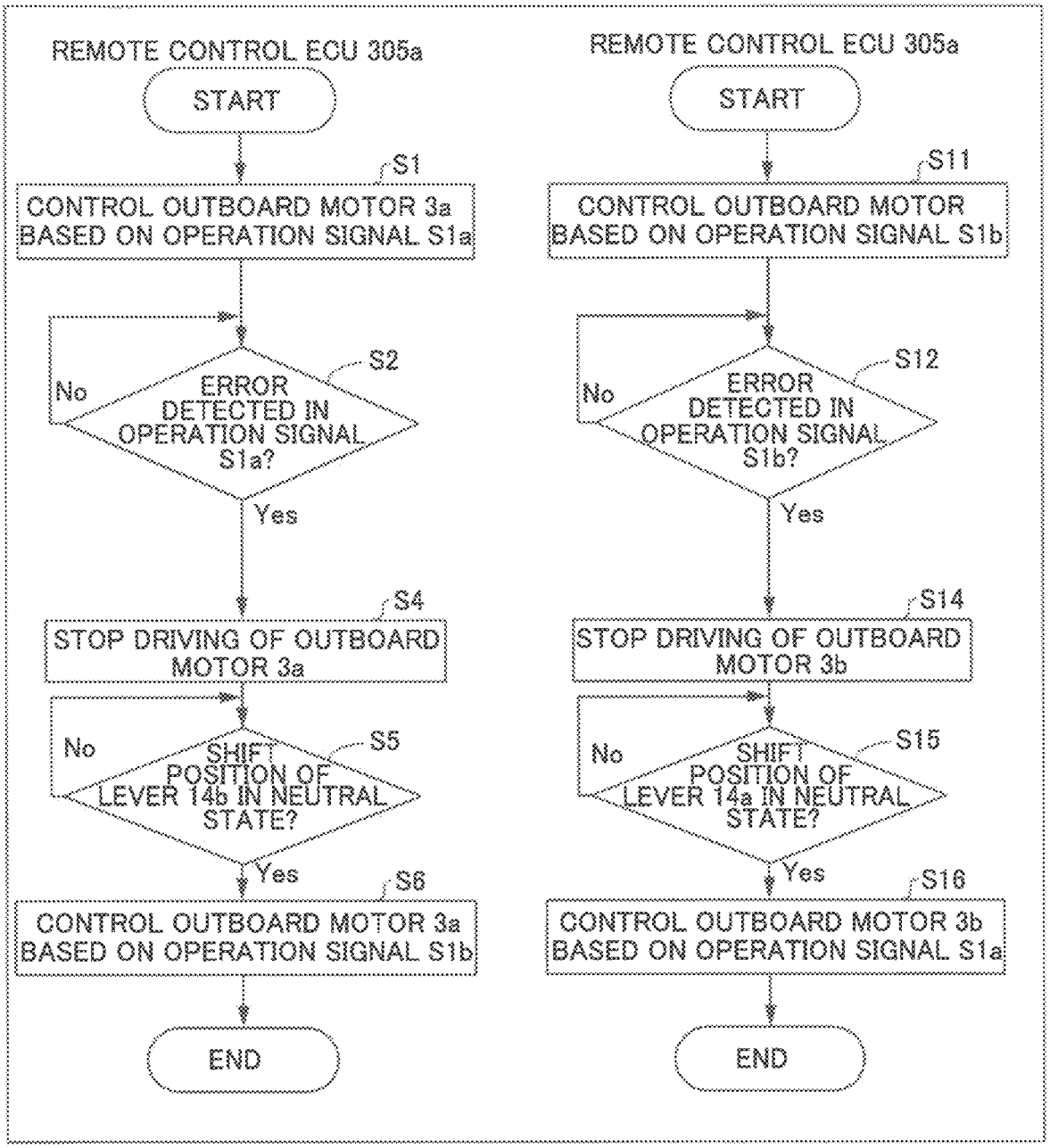
FIG. 10 is a flowchart showing a control process of the boat maneuvering control system according to the third preferred embodiment of the present invention.

A boat maneuvering control method for the boat 301 (boat maneuvering control system 300) according to the third preferred embodiment is now described with reference to FIG. 10. This control process is executed by the remote control ECUs 305*a* and 305*b*.

In the control process by the remote control ECU 305*a* according to the third preferred embodiment, step S3 is not executed among step S1 to step S6 in the control process (see FIG. 5) by the remote control ECU 5*a* according to the first preferred embodiment. That is, after step S2 is executed, the process advances to step S4. The remaining control process by the remote control ECU 305*a* is the same or similar as the control process (see FIG. 5) by the remote control ECU 5*a* according to the first preferred embodiment.

In the control process by the remote control ECU 305*b* according to the third preferred embodiment, step S13 is not executed among step S11 to step S16 in the control process (see FIG. 5) by the remote control ECU 5*b* according to the first preferred embodiment. That is, after step S12 is executed, the process advances to step S14. The remaining control process by the remote control ECU 305*b* is the same or similar as the control process (see FIG. 5) by the remote control ECU 5*b* according to the first preferred embodiment.

According to the third preferred embodiment, the following advantageous effects are achieved.

According to the third preferred embodiment, the boat maneuvering control system 300 includes the outboard motors 303*a* and 303*b* and the remote control ECUs 305*a* and 305*b*. Accordingly, the boat 301 including two outboard motors is provided in which a reduction in the propulsive force of the outboard motor 3*a* or 3*b* is significantly reduced or prevented even when an error occurs in an operation signal S1*a* or Sib. The remaining advantageous effects of the third preferred embodiment are similar to those of the first preferred embodiment.

Modified Examples

Preferred embodiments of the present invention described above are illustrative in all points and not restrictive. The extent of the present invention is not defined by the above description of the preferred embodiments but by the scope of the claims, and all modifications (modified examples) within the meaning and range equivalent to the scope of the claims are further included.

For example, while an example in which the outboard motors attached to the outside of the hull are used as propulsion devices has been described in each of the first to third preferred embodiments described above, the present invention is not restricted to this. As propulsion devices, inboard motors attached to the inside of the hull or inboard-outboard motors (stern drives) provided inside and outside the hull may be used.

While an example in which the boat includes the three or two outboard motors has been described in each of the first to third preferred embodiments described above, the present invention is not restricted to this. The boat may include one outboard motor or four or more outboard motors.

While an example in which each of the remote control ECUs 5*a*, 5*b*, and 5*c* performs a control to switch from controlling the corresponding outboard motor based on the operation signal including the error information to controlling the corresponding outboard motor based on the operation signal different from the operation signal including the error information upon acquiring the error information has been described in the first preferred embodiment described above, the present invention is not restricted to this. That is, at least one of the remote control ECUs 5*a*, 5*b*, and 5*c* may perform the switching control described above. For example, only the remote control ECU 5*c* may perform the switching control described above. In such a case, the remote control ECU 5*a* (or 5*b*) may stop driving the corresponding outboard motor 3*a* (or 3*b*) while transmitting the error notification signal S3*a* (or S3*b*) to the remote control ECU 5*c* upon acquiring the error information D. In such a case, the outboard motor 3*c* is continuously driven even upon acquiring the error information D.

While an example in which it is assumed that an error has been detected in the operation signal when the signal voltage of the operation signal is out of the voltage range (i.e., within the error range) has been described in each of the first to third preferred embodiments described above, the present invention is not restricted to this. For example, it may be assumed that an error has been detected in the operation signal when the current value of the operation signal is out of a predetermined range (i.e., within an error range).

While an example in which the signal voltage is minimized in the reverse movement state R, and the signal voltage is maximized in the forward movement state F, as shown in FIG. 4 has been described in each of the first to third preferred embodiments described above, the present invention is not restricted to this. For example, in the boat maneuvering control system, the signal voltage may be maximized in the reverse movement state R, and the signal voltage may be minimized in the forward movement state F. Alternatively, the boat maneuvering control system may output a boat maneuvering signal in which information about the shift state is separated from information indicating the magnitude of the propulsive force.

While an example in which the remote control ECU 5*c* (205*c*) sets the propulsive force of the outboard motor 3*c* to a substantially average value of the propulsive force based on the operation signal Sla and the propulsive force based on the operation signal S1*b* has been described in each of the first and second preferred embodiments described above, the present invention is not restricted to this. For example, a value obtained by performing a calculation on the average value of the propulsive force based on the operation signal Sla and the propulsive force based on the operation signal S1*b* using a predetermined value (a value obtained by adding the predetermined value to the average value, a value obtained by subtracting the value obtained from the average value, a value obtained by multiplying the average value by the predetermined value, or a value obtained by dividing the average value by the predetermined value) may be used as the propulsive force of the outboard motor 3*c*.

While an example in which the remote control ECUs perform the switching control described above after the shift position has been put into the neutral state N has been described in each of the first to third preferred embodiments described above, the present invention is not restricted to this. For example, in the boat maneuvering control system, the remote control ECUs may perform the switching control described above regardless of whether or not the shift position is in the neutral state N.

While an example in which the boat includes the two boat maneuvering stations has been described in the third preferred embodiment described above, the present invention is not restricted to this. For example, the boat may include three or more boat maneuvering stations.

While the process operations performed by the controller are described using flowcharts in a flow-driven manner in which processes are performed in order along a process flow for the convenience of illustration in the preferred embodiments described above, the present invention is not restricted to this. In the present invention, the process operations performed by the actuator controller may be performed in an event-driven manner in which the processes are performed on an event basis. In this case, the process operations performed by the controller may be performed in a complete event-driven manner or in a combination of an event-driven manner and a flow-driven manner.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A boat maneuvering control system comprising:

a propulsion device;

a controller configured or programmed to control a propulsive force of the propulsion device; and a plurality of operators, each of which outputs to the controller an operation signal to control the propulsive force of the propulsion device; wherein the controller is configured or programmed to perform a control to switch from controlling the propulsion device based on at least a first operation signal that includes error information among a plurality of operation signals output from the plurality of operators, to controlling the propulsive force of the propulsion device based on a second operation signal different from the first operation signal upon acquiring the error information.

2. The boat maneuvering control system according to claim 1, wherein the error information includes at least one of information indicating that an error has been detected in the operation signal and information indicating a communication error with another controller.

3. The boat maneuvering control system according to claim 1, wherein the boat includes:

a plurality of propulsion devices including at least a left propulsion device provided on a left portion of a stern of a hull, and a right propulsion device provided on a right portion of the stern of the hull; and a plurality of controllers including at least a left controller configured or programmed to control a propulsive force of the left propulsion device, and a right controller configured or programmed to control a propulsive force of the right propulsion device;

the plurality of operators include a left operator that outputs to the left controller a left operation signal to control the propulsive force of the left propulsion device, and a right operator that outputs to the right controller a right operation signal to control the propulsive force of the right propulsion device; and a first controller of the plurality of controllers is configured or programmed to perform a control to switch from controlling the propulsion device corresponding to the first controller based on at least the first operation signal including the error information among the left operation signal and the right operation signal to controlling the propulsive force of the propulsion device corresponding to the first controller based on the second operation signal among the left operation signal and the right operation signal upon acquiring the error information.

4. The boat maneuvering control system according to claim 3, wherein the first controller is configured or programmed to perform a control to switch from controlling the propulsion device corresponding to the first controller based on at least the first operation signal to controlling the propulsive force of the propulsion device corresponding to the first controller based on the second operation signal upon acquiring information indicating that an error has been detected in the operation signal acquired from a corresponding one of the plurality of operators.

5. The boat maneuvering control system according to claim 3, wherein the plurality of propulsion devices include a central propulsion device provided at a center of the stern of the hull;

the first controller includes a central controller configured or programmed to acquire the left operation signal from the left controller and acquire the right operation signal from the right controller so as to control a propulsive force of the central propulsion device based on the left operation signal and the right operation signal; and the central controller is configured or programmed to perform a control to switch from controlling the propulsive force of the central propulsion device based on the left operation signal and the right operation signal to controlling the propulsive force of the central propulsion device based on the second operation signal, which is one of the left operation signal and the right operation signal, upon acquiring the error information.

6. The boat maneuvering control system according to claim 5, wherein the central controller is configured or programmed to perform a control to switch from controlling the propulsive force of the central controller based on the left operation signal and the right operation signal to controlling the propulsive force of the central propulsion device based on the second operation signal, which is one of the left operation signal and the right operation signal, upon acquiring from the left controller or the right controller information indicating that an error has been detected in the operation signal or detecting a communication error with the left controller or the right controller.

7. The boat maneuvering control system according to claim 5, wherein the central controller is configured or programmed to perform a control to switch from controlling the central propulsion device such that the propulsive force of the central propulsion device is a substantially average value of the propulsive force based on the left operation signal and the propulsive force based on the right operation signal to controlling the central propulsion device such that the propulsive force of the central propulsion device is based on the second operation signal, which is one of the left operation signal and the right operation signal, upon acquiring the error information.

8. The boat maneuvering control system according to claim 3, wherein each of the plurality of operators includes a shift operator; and the first controller is configured or programmed to perform a control to switch from controlling the propulsive force of the propulsion device based on the first operation signal to controlling the propulsive force of the propulsion device based on the second operation signal when the first controller acquires the error information, and the shift operator corresponding to the second operation signal is in a neutral state.

9. The boat maneuvering control system according to claim 1, further comprising:

a plurality of boat maneuvering stations, each of which includes an operator and outputs the operation signal to the controller; wherein the controller is configured or programmed to perform a control to switch from controlling the propulsion device based on the first operation signal output from a boat maneuvering station including the error information among the plurality of boat maneuvering stations, to controlling the propulsive force of the propulsion device based on the second operation signal output from a boat maneuvering station different from the boat maneuvering station including the error information upon acquiring the error information.

10. The boat maneuvering control system according to claim 9, wherein at least one of the plurality of boat maneuvering stations includes the plurality of operators and a signal transmission controller configured or programmed to acquire the operation signal from each of the plurality of operators and transmit the operation signal to the controller; and the controller is configured or programmed to perform a control to switch from controlling the propulsion device based on the first operation signal to controlling the propulsive force of the propulsion device based on the second operation signal upon acquiring, from the signal transmission controller, information indicating that an error has been detected in the operation signal or acquiring a communication error with the signal transmission controller.

11. A boat maneuvering control system comprising:

a plurality of propulsion devices including at least a left propulsion device provided on a left portion of a stern of a hull, and a right propulsion device provided on a right portion of the stern of the hull;

a plurality of controllers including at least a left controller configured or programmed to control a propulsive force of the left propulsion device, and a right controller configured or programmed to control a propulsive force of the right propulsion device; and a plurality of operators including a left operator that outputs to the left controller a left operation signal to control the propulsive force of the left propulsion device, and a right operator that outputs to the right controller a right operation signal to control the propulsive force of the right propulsion device; wherein a first controller of the plurality of controllers is configured or programmed to perform a control to switch from controlling a propulsion device corresponding to the first controller among the plurality of propulsion devices based on at least a first operation signal that includes error information among the left operation signal and the right operation signal to controlling a propulsive force of the propulsion device corresponding to the first controller based on a second operation signal different from the first operation signal among the left operation signal and the right operation signal upon acquiring the error information.

12. A boat maneuvering control system comprising:

a propulsion device;

a controller configured or programmed to control a propulsive force of the propulsion device; and a plurality of boat maneuvering stations, each of which includes an operator that outputs an operation signal to control the propulsive force of the propulsion device and outputs the operation signal to the controller; wherein the controller is configured or programmed to perform a control to switch from controlling the propulsion device based on the operation signal output from a boat maneuvering station that includes error information among the plurality of boat maneuvering stations to controlling the propulsive force of the propulsion device based on the operation signal output from a boat maneuvering station different from the boat maneuvering station including the error information upon acquiring the error information.

13. A boat maneuvering control method for controlling a propulsive force of a propulsion device, the method comprising:

outputting a plurality of operation signals to control the propulsive force of the propulsion device; and performing a control to switch from controlling the propulsion device based on at least a first operation signal that includes error information among the plurality of operation signals that have been output, to controlling the propulsive force of the propulsion device based on a second operation signal different from the first operation signal upon acquiring the error information.

14. The boat maneuvering control method according to claim 13, wherein the boat includes a plurality of controllers configured or programmed to control the propulsive force of the propulsion device;

the plurality of controllers are configured or programmed to communicate the plurality of operation signals with each other; and the performing of the switching control includes performing a control to switch from controlling the propulsion device based on the first operation signal including the error information to controlling the propulsive force of the propulsion device based on the second operation signal upon acquiring the error information including at least acquiring information including at least one of information indicating that an error has been detected in the operation signals and information indicating a communication error between the plurality of controllers.

15. The boat maneuvering control method according to claim 13, wherein the boat includes a plurality of propulsion devices including at least a left propulsion device provided on a left portion of a stern of a hull, and a right propulsion device provided on a right portion of the stern of the hull;

the outputting of the plurality of operation signals includes outputting a left operation signal to control a propulsive force of the left propulsion device among the plurality of operation signals, and outputting a right operation signal to control a propulsive force of the right propulsion device among the plurality of operation signals; and the performing of the switching control includes performing a control to switch from controlling the propulsion device based on at least the first operation signal including the error information among the left operation signal and the right operation signal to controlling the propulsive force of the propulsion device based on the second operation signal, which is one of the left operation signal and the right operation signal, upon acquiring the error information.

16. The boat maneuvering control method according to claim 15, wherein the plurality of propulsion devices include a central propulsion device provided at a center of the stern of the hull; and the performing of the switching control includes performing a control to switch from controlling a propulsive force of the central propulsion device based on the left operation signal and the right operation signal to controlling a propulsive force of the central propulsion device based on the second operation signal, which is one of the left operation signal and the right operation signal, upon acquiring the error information.

17. The boat maneuvering control method according to claim 16, wherein the boat includes a left controller configured or programmed to control the propulsive force of the left propulsion device, a right controller configured or programmed to control the propulsive force of the right propulsion device, and a central controller configured or programmed to communicate with each of the left controller and the right controller and control the propulsive force of the central propulsion device; and the performing of the switching control includes performing a control to switch from controlling the propulsive force of the central propulsion device based on the left operation signal and the right operation signal to controlling the propulsive force of the central propulsion device based on the second operation signal, which is one of the left operation signal and the right operation signal, when the central controller acquires, from the left controller or the right controller, information indicating that an error has been detected in the operation signal or detects a communication error with the left controller or the right controller.

18. The boat maneuvering control method according to claim 16, wherein the performing of the switching control includes performing a control to switch from controlling the central propulsion device such that the propulsive force of the central propulsion device is a substantially average value of the propulsive force based on the left operation signal and the propulsive force based on the right operation signal to controlling the central propulsion device such that the propulsive force of the central propulsion device is based on the second operation signal, which is one of the left operation signal and the right operation signal, upon acquiring the error information.

19. The boat maneuvering control method according to claim 15, wherein the performing of the switching control includes performing a control to switch from controlling the propulsive force of the propulsion device based on the first operation signal to controlling the propulsive force of the propulsion device based on the second operation signal when the error information is acquired and a shift state corresponding to the second operation signal is in a neutral state.

20. The boat maneuvering control method according to claim 13, wherein the outputting of the operation signals includes outputting the operation signals from a plurality of boat maneuvering stations, respectively; and the performing of the switching control includes performing a control to switch from controlling the propulsion device based on the first operation signal output from a boat maneuvering station including the error information among the plurality of boat maneuvering stations, to controlling the propulsive force of the propulsion device based on the second operation signal output from a boat maneuvering station different from the boat maneuvering station including the error information upon acquiring the error information.

* * * * *